US006591437B1

(12) United States Patent
Phillips

(10) Patent No.: US 6,591,437 B1
(45) Date of Patent: Jul. 15, 2003

(54) THERAPEUTIC MATTRESS AND BUILT-IN CONTROLS

(75) Inventor: Bruce Phillips, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 08/632,601

(22) Filed: Apr. 15, 1996

(51) Int. Cl.[7] ..... A47C 27/08
(52) U.S. Cl. ..... 5/713; 5/706; 5/708; 5/710
(58) Field of Search ..... 5/706, 708–713, 5/424

(56) References Cited

U.S. PATENT DOCUMENTS

| | | | | | |
|---|---|---|---|---|---|
| 4,203,098 | A | * | 5/1980 | Muncheryan | 340/575 |
| 4,638,519 | A | * | 1/1987 | Hess | 5/455 |
| 4,797,962 | A | * | 1/1989 | Goode | 5/713 |
| 4,800,599 | A | * | 1/1989 | Korchinski et al. | 5/507 |
| 4,864,671 | A | * | 9/1989 | Evans | 5/453 |
| 4,890,344 | A | * | 1/1990 | Walker | 5/713 |
| 4,949,412 | A | * | 8/1990 | Goode | 5/914 |
| 4,986,738 | A | * | 1/1991 | Kawasaki et al. | 5/713 |
| 5,020,176 | A | * | 6/1991 | Dotson | 5/713 |
| 5,051,673 | A | * | 9/1991 | Goodwin | 5/713 |
| 5,249,319 | A | | 10/1993 | Higgs | |
| 5,325,551 | A | * | 7/1994 | Tappel et al. | 5/714 |
| 5,367,726 | A | * | 11/1994 | Chaffee | 5/449 |
| 5,500,965 | A | * | 3/1996 | Hannagan et al. | 5/655 |
| 5,749,374 | A | * | 5/1998 | Schneider, Sr. | 5/625 |

OTHER PUBLICATIONS

"The Advance Series Bed With The New ZoneAire Sleep Surface," Hill–Rom 1994.

* cited by examiner

*Primary Examiner*—Teri Pham Luu

(57) ABSTRACT

A decubitus mattress includes an inflatable cell surrounded by foam with a built-in low-voltage (AC) air pump assembly for controlling the air cell's inflation. In some embodiments, a mattress includes a plurality of inflatable cells, one or more of which (particularly at the foot end of the mattress) can be selectively deflated with valves that are located along the side of the mattress, in corresponding positions.

18 Claims, 5 Drawing Sheets

THERAPEUTIC MATTRESS AND BUILT-IN CONTROLS

BACKGROUND OF THE INVENTION

1. Field of the Invention

This invention relates generally to the field of inflatable decubitus mattresses. More particularly, this invention relates to a therapeutic mattress which includes a plurality of inflatable cells surrounded by a foam border, with at least one such inflatable cell disposed at a foot end of the mattress, a low-voltage (AC) air supply and other controls integrally associated with the mattress and operable for controlling inflation and deflation of the cells, including selective deflation of certain cells for localized pressure relief.

2. Related Art

There are many types of decubitus mattresses. There are mattresses that combine both air and foam for support, mattresses with heating elements, inflatable mattresses with pressure sensitivity control, alternating pressure mattresses, and many others.

However, there remains a continuous need to improve therapeutic mattresses to provide the patient with the most comfortable and therapeutically effective mattress as possible. On the other hand, there is also a need to make such a mattress affordable, convenient and easy to use. The present invention is directed to improvements in therapeutic mattresses.

BRIEF SUMMARY

It is an object of the present invention to improve therapeutic mattresses.

It is another object to improve the therapeutic aspects of mattresses.

Another object is to overcome the obstacles or problems encountered in the manufacture and use of therapeutic mattresses.

Still another object is to provide a pressure reducing mattress in which the pressure in the mattress and/or portions of the mattress are adjustable as desired.

Accordingly, the present invention relates to a mattress having a plurality of inflatable cells with at least one cell disposed at a foot end of the mattress, a plurality of controls integrally associated with the mattress and operably associated with an air pump assembly for controlling inflation and deflation of the cells. The air pump assembly is a low-voltage (AC) air pump assembly and is preferably integrally formed in the mattress. Another aspect of the invention is directed to a mattress, comprising an inflatable cell and a low-voltage air pump assembly integrally formed within the mattress for supplying and controlling air flow to said inflatable cell.

One control is provided having an actuator for controlling the softness/firmness of the mattress via inflation/deflation of the cells and one control is provided for controlling the inflation/deflation of the foot end cell. Preferably, a plurality of inflatable cells are disposed in the foot end of the mattress and separate controls are provided each having an actuator for controlling inflation/deflation of each one of the foot end cells. Additionally, the mattress includes at least one, and preferably a plurality, of the inflatable cells disposed in a CPR midregion of the mattress and means for rapidly deflating the same.

Other objects and advantages will be apparent to those skilled in the art upon viewing the drawings and reading the detailed description and claims set forth hereafter, particularly when viewed in light of the prior art and the challenges encountered in such art.

DETAILED DESCRIPTION OF PRESENTLY PREFERRED EMBODIMENTS

Figure 1:
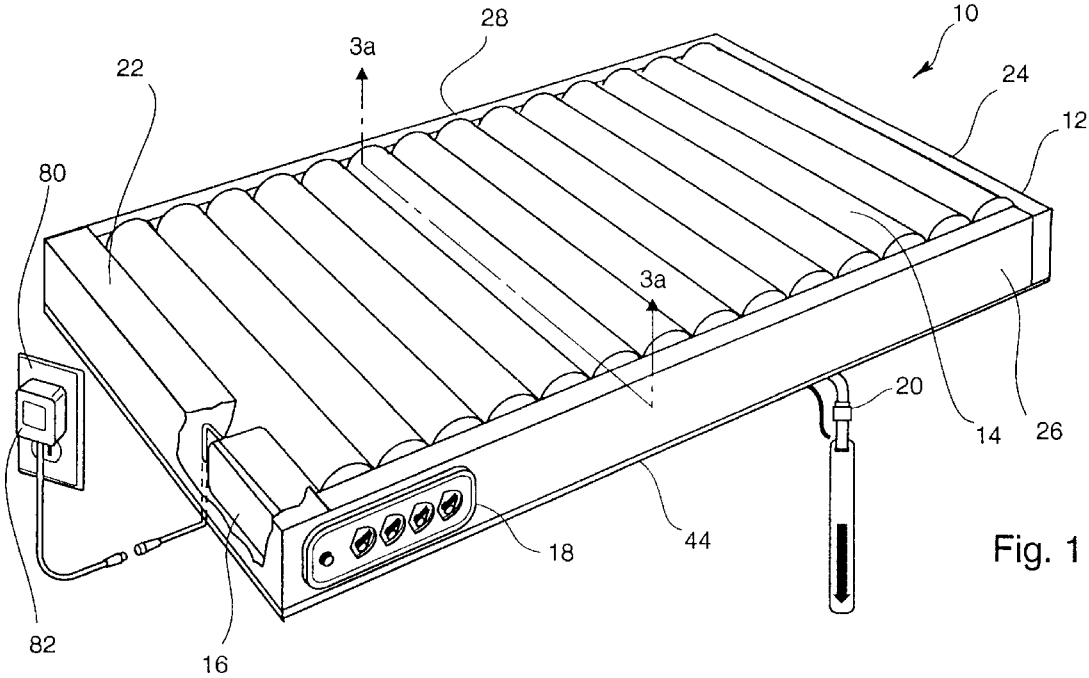
FIG. 1 is a perspective view of the mattress 10 that is a presently-preferred embodiment of the present invention.

Referring to the drawings, the inflatable mattress of the present invention is generally designated by the numeral 10 and is intended to deliver improved therapeutic effect with a reduced pressure to a patient. The inflatable mattress 10 generally includes a base 12, a plurality of inflatable cells 14, a power driven air pump assembly 16, a control panel assembly 18 and means 20 for CPR deflation.

Figure 2:
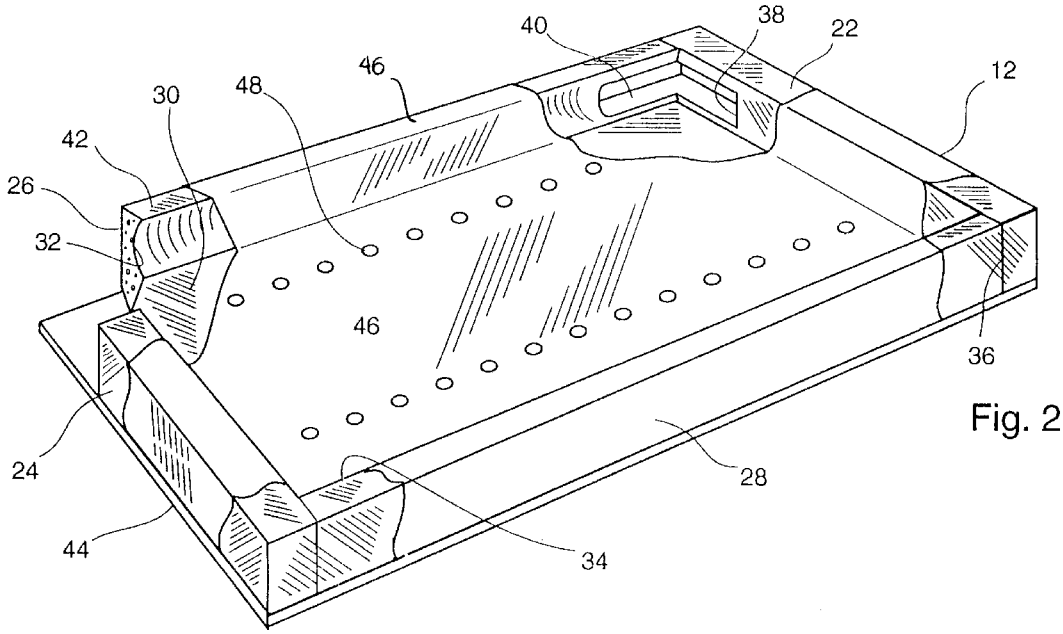
FIG. 2 is a perspective view with a partial cut-away of the base 12 and liner 46 of the mattress 10 of FIG. 1.

As seen in FIG. 2, the base 12 includes an end 22 and an end 24 which are interconnected by a side 26 and a side 28 to form a generally rectangular structure. A base 30 interconnects the ends 22 and 24 and sides 26 and 28. The sides 26 and 28 each have a concave surface 32 and 34, respectively, which together with ends 22 and 24 and base 30, nest and contain the inflatable cells 14. The end 22 includes a recessed surface 38 adjacent the side 26 to receive the air pump assembly 16 therein. The side 26 has a recessed surface 40 adjacent the end 22 which is configured to receive the control panel assembly 18 therein. The base 12 is a foam material and may be of any suitable cellular plastic material which is balanced to provide sufficient rigidity to retain the inflatable cells 14, air pump assembly 16 and control panel assembly 18, and flexibility to permit bending thereof, such as polyurethane, rubber latex, polyethylene or vinyl which have been processed in a manner to minimize combustion thereof.

The base 12 has a non woven fabric 42 cut to the dimensions of an exterior surface of the ends 22 and 24, sides 26 and 28 and base 30 and glued thereto. A non woven bottom cover 44 cut to the dimensions to span over bottom surfaces of each of the ends 22 and 24, sides 26 and 28 and base 30 and is provided likewise connected thereto. The mattress 10 is provided with a PVC liner 46 covering which is contoured to cover an exterior surface of the base 12 and has female mounting members 48 to which the inflatable cells 14 connect as described hereinafter.

Figure 3B:
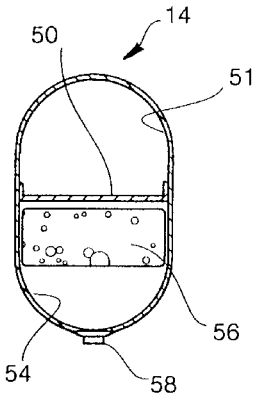
FIG. 3*b* is a cross-sectional view of the inflatable cell 14 through line 3*b*—3*b* of the cell as shown in FIG. 3*a*.
Figure 3A:
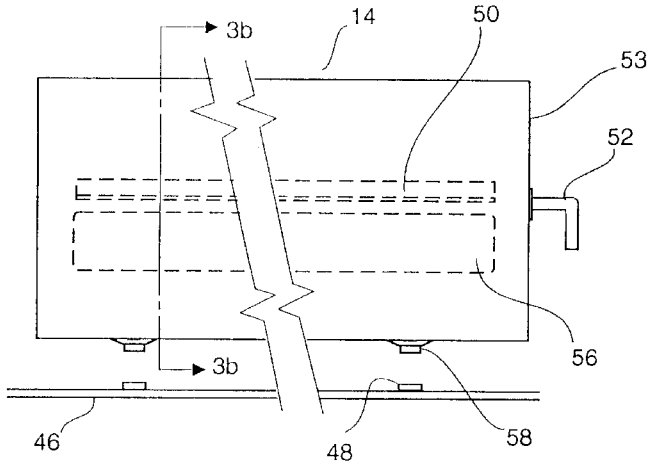
FIG. 3*a* is a cross-sectional view of an inflatable cell 14 through line 3*a*—3*a* of the mattress 10 as shown in FIG. 1.
Figure 4:
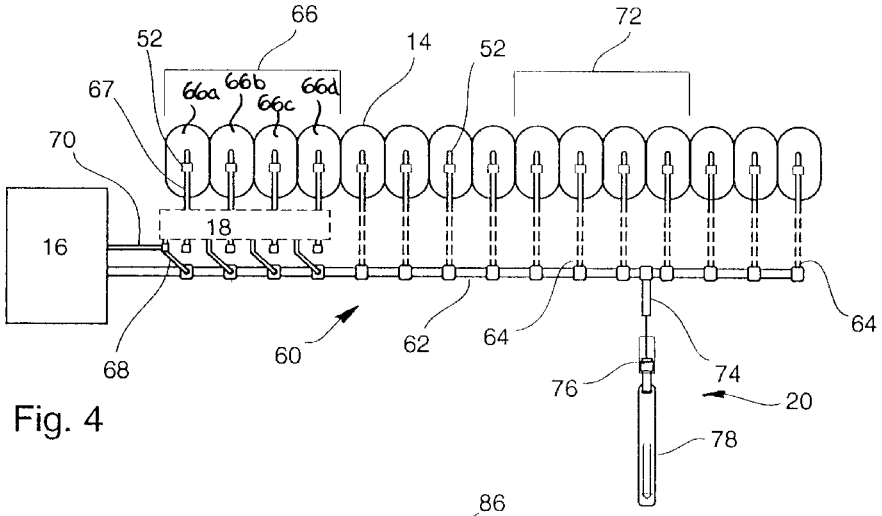
FIG. 4 is a side view of an air hose assembly 60 of the mattress 10 of FIG. 1.

In FIGS. 1 and 4, there are shown fifteen (15) inflatable cells. The number and size of cells 14 will vary according to the particular mattress size or application desired. As seen in FIGS. 3*a* and 3*b*, each of the inflatable cells 14 is generally of an oval elongated shape with a baffle 50 extending partially along the length of the cell 14 and is connected to an inner side 51 to form a partial partition to permit fluid communication thereabout. The cell 14 is substantially sealed with the exception of an inlet line 52 to permit the inflation and deflation of the cell 14. Disposed within what is predetermined to be a bottom portion 54 of the cell is an elongated foam piece 56 made of a similar type of material described above which extends partially along the length of the cell 14 and is a length generally that of the baffle 50. The foam piece 56 serves as a backup support cushion in the event that the cell 14 becomes deflated. Male mounting pads 58 are connected to the bottom portion 54 of the cell 14 and are positionable within the female mounting members 48 to aid in positioning the cells 14 within the base 12.

FIG. 4 shows an air hose assembly 60 which is disposed adjacent side surface 28 and includes a tubing 62 operatively connected to air pump assembly 16 and has a plurality of line connections 64 which connect to a respective inlet line 52. Four of the cells 14 disposed nearest the first end 22 are preferably predetermined to be foot end cells 66. The foot end cells 66 are operably associated with tubing 62 by way of lines 67 and 68, inflation/deflation valve members 86 and control panel assembly 18 described hereinafter. The line 68 nearest the first end 22 includes a pressure feedback hose 70 connected to the air pump assembly 16. A group of cells 14 beginning at about the fourth cell 14 from the second end 24 are designated as the torso region 72. The tubing 62 which proximately supplies air to the cells 14 within the torso region 72 includes a relief line 74.

As seen in FIG. 4, the CPR deflation means 20 includes a CPR plug 76 and an attached CPR deflation strap 78. The CPR plug 76 is removably sealably disposed within the relief line 74 to normally allow inflation of the cushions 14. However, in the unfortunate event that the patient requires CPR, the CPR plug 76 may be readily removed by pulling on the CPR deflation strap 78 to permit deflation of the cells 14 to generally provide a more rigid CPR surface and permit easier access to the chest of the patient. Due to the proximity of plug 46 and the typical weight distribution of a patient supported on mattress 10, the torso region 72 tends to deflate most rapidly, as compared with the other cells 14 of mattress 10.

Figure 5:
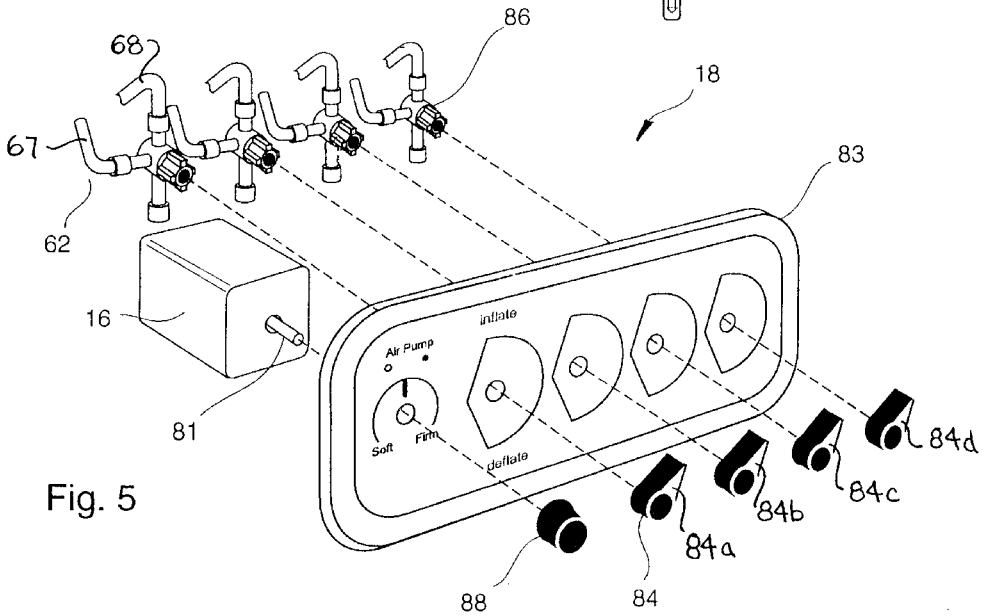
FIG. 5 is an exploded perspective view of a control panel assembly 18 of the mattress in FIG. 1.

As depicted in FIG. 5, the control panel assembly 18 is operably associated with the air pump assembly 16, an AC supply 80 and a tranformer 82 described hereinafter. The control panel assembly 18 includes a control panel 83 which is operably associated the air pump assembly 16. The potentiometer member 81 is operably associated with the control panel 83 to enable a predetermined pressure to be achieved by adjusting the potentiometer member 81 to a certain target voltage. The potentiometer member 81 connects to the air pump assembly 16, the particulars of which are described hereinafter. The control panel 83 includes a plurality of foot end cell inflation/deflation knobs 84 which are operably connected to a respective inflation/deflation valve member 86 which in turn operatively interconnects lines 67 and 68 to individually inflate or deflate one or more of the foot end cells 66. Each valve member 86 in the preferred embodiment is a 3-way stop-cock valve with Luer lock fittings. The positions of the knobs 84*a*–84*d* are situated along panel 83 in a manner that corresponds with the relative positions of foot cushions 66*a*–66*d*; hence knob 84*a* controls inflation of cushion 66*a*, and so on. Additionally, a soft/firm knob 88 is operatively connected to the potentiometer member 81 for controlling the firmness/softness of the mattress 10 via regulating air pressure to the cells 14. The control panel assembly 18 can be connected to the surface 40 by way of applying releasably-engageable hook-and-loop type material such as known fastener material trademarked VELCRO® pieces to the perimeter of the control panel 83 and the surface 40 or by other suitable means which preferably allows easy removal of the control panel assembly 18 for reasons of inspection, repair and/or cleaning.

Figure 6:
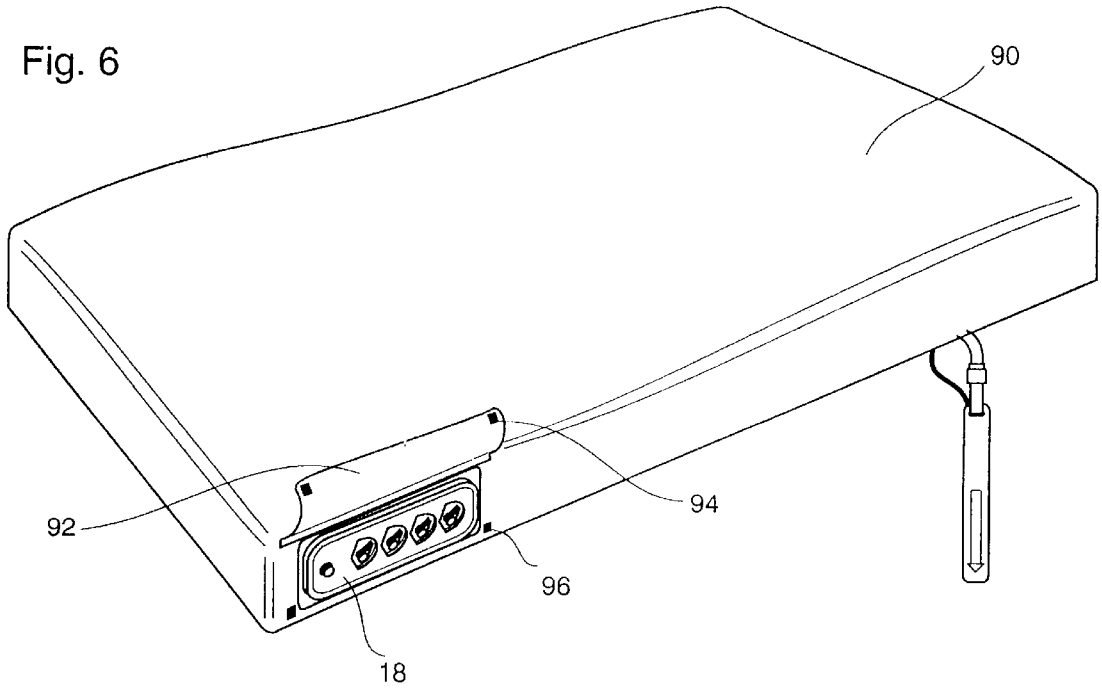
FIG. 6 is a perspective view of a top cover 90 over the mattress 10 in FIG. 1.

FIG. 6 depicts a top cover 90 for use with the mattress and is of a size and configuration to substantially envelop the mattress 10. The top cover 90 includes an openable flap 92, which when properly disposed on the mattress 10, lies adjacent the control panel assembly 18 releasably-engageable hook-and-loop type material such as the known fastener material trademarked VELCRO® pieces 94 and 96 are provided on the top cover 90 permit opening and closing of the flap 92.

Figure 9:
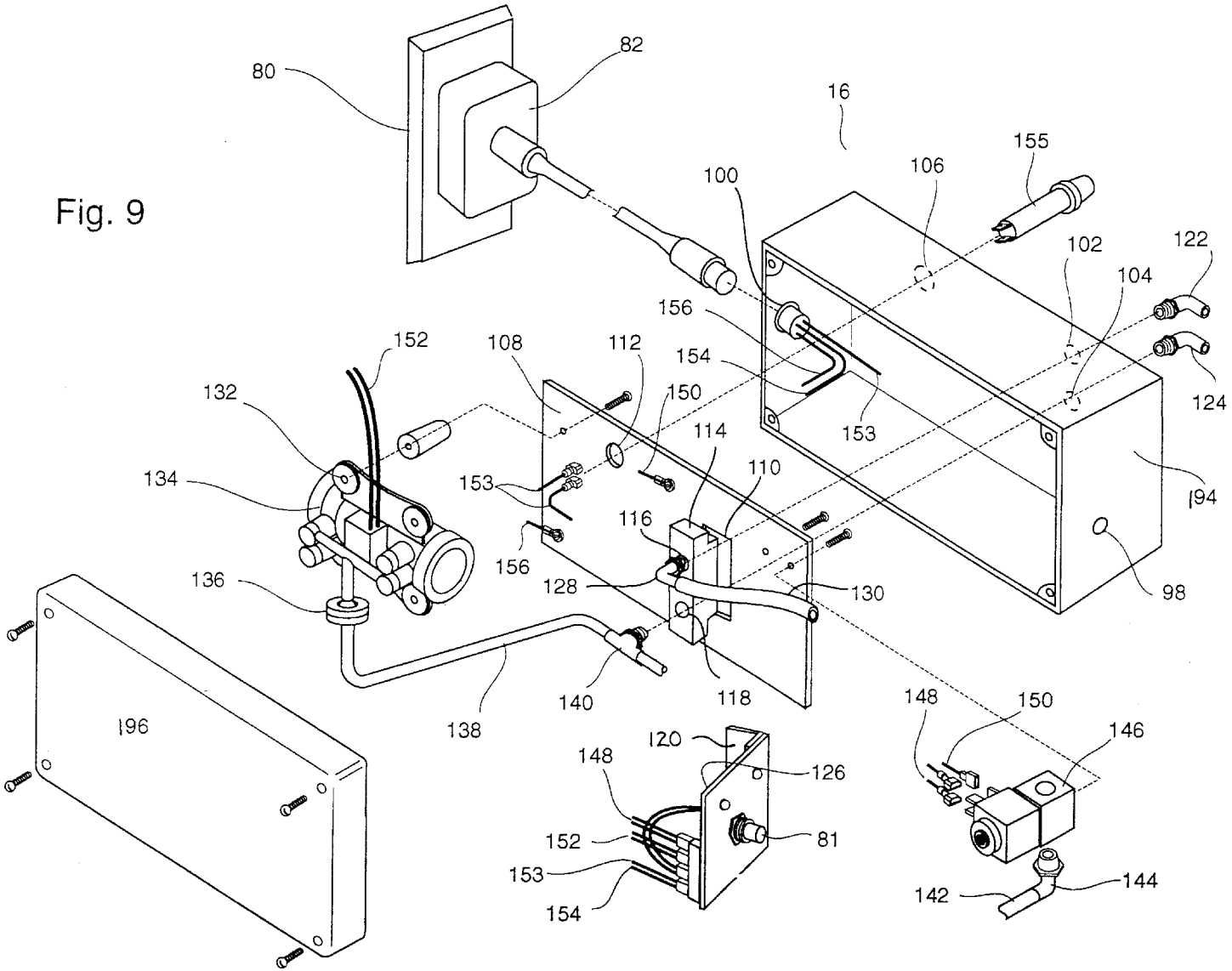
FIG. 9 is a exploded view of an air pump assembly 16 of the mattress 10 of FIG. 1.
Figure 10:
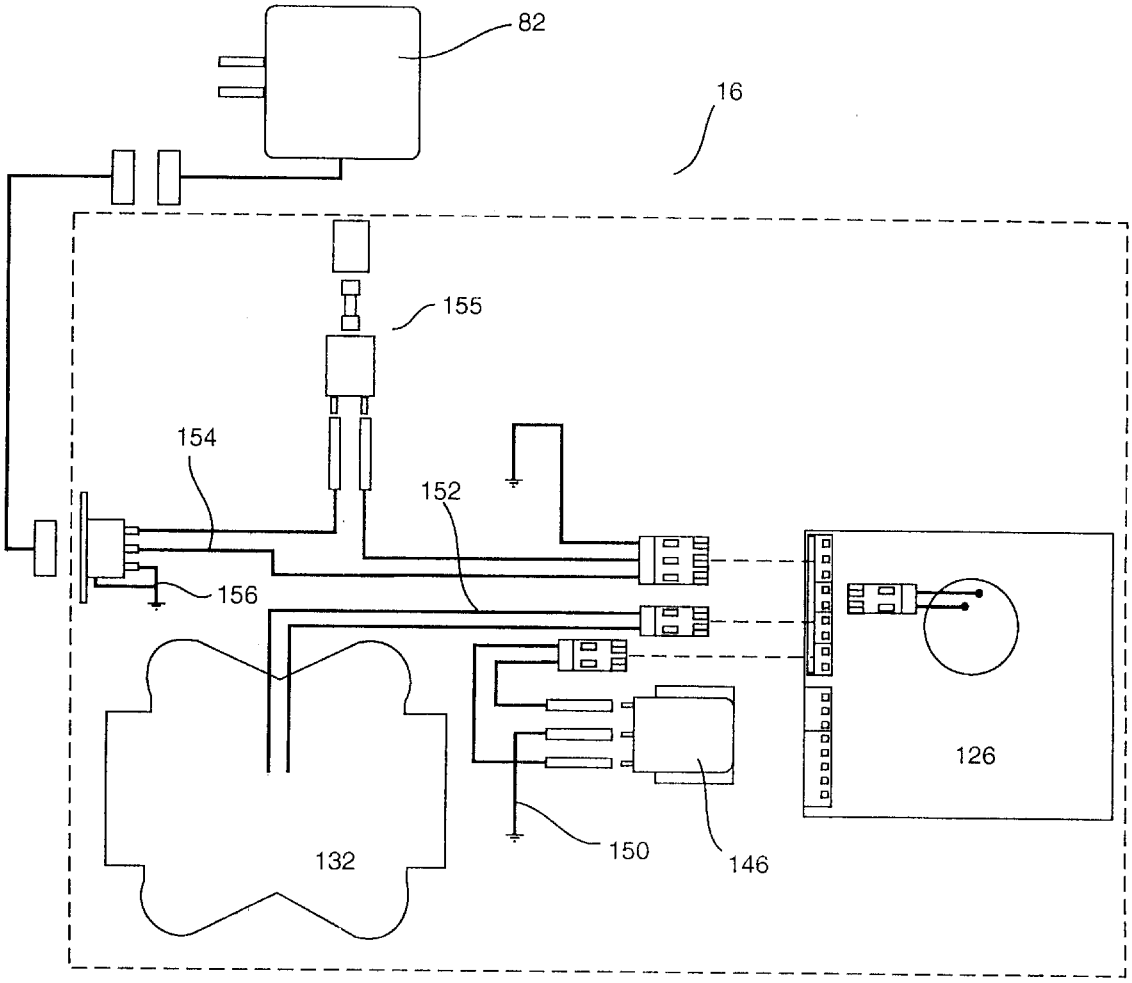
FIG. 10 is a schematic of the electrical components of the mattress 10 of FIG. 1.

The air pump assembly 16 is best represented in FIGS. 9 and 10 and is operably associated with the conventional voltage (e.g., 115 volts) AC supply 80 via the transformer 82. The transformer 82 is operably connected to the AC supply 80. The transformer 82 supplies a low voltage (preferably, about 12 volts) to the air pump assembly 16. Such a low voltage AC supply helps ensure the safety of patient and caregiver, particularly in the event mattress 10 is drenched, despite incorporating the air supply 16 and controls in the mattress. The low-voltage aspect of integral AC pump 132, which is provided by adding windings to a conventional AC pump, is also beneficial in that it has been found to provide quieter operation.

The air pump assembly 16 has housing portions 94 and 96 which are threadably removably connectable to each other. The housing portion 94 has open surfaces 98, 100, 102, 104 and 106. A mounting plate 108 is fixably disposed within the housing portion 94 and has open surfaces 110 and 112 which are positioned adjacent open surfaces 102 and 104, and 106, respectively. A manifold 114 connects to the mounting plate 108 at the open surface 110 and has a pair of bored surfaces 116 and 118 coaxially positioned with the open surfaces 102 and 104, respectively. Connected to an end of the mounting plate 108 is an L-shaped bracket 120.

Elbow tube fittings 122 and 124 have an end connecting through open surfaces 102 and 104, respectively, to bored surfaces 116 and 118, respectively, of the manifold 114. The remaining end of the elbow tube fittings 122 and 124 connect to lines 70 and 62, respectively.

A circuit board 126 having pressure sensitive components is operably connected to the L-shaped bracket 120. The potentiometer member 81 operatively rotatably connects to the circuit board 126 for regulating the amount of air pressure within the cells 14. When positioned within the housing portion 94, the potentiometer member 81 extends through the open surface 98 to the control panel 83 and connects to the knob 88. An elbow tube fitting 128 connects to bored surface 116 and line 130 which in turn connects to the circuit board 126 to complete the pressure feedback to thereto.

A pump 132 which includes diametrically opposed reciprocating diaphragms 134 is threadably removably connected to the mounting plate 108. A one way check valve 136 operably interconnects the pump 132 and a line 138 which in turn is connected to an end of a T-shaped tube fitting 140. An intermediate portion of the T-shaped tube fitting 140 connects to the bored surface 118. A remaining end of the T-Shaped tube fitting 140 connects to an exhaust line 142 which in turn connects to an elbow fitting 144.

The elbow fitting 144 connects to a solenoid valve 146 which is threadably removably connected to the mounting plate 108. The solenoid valve 146 is electrically operatively connected to the circuit board 126 via lines 148 and is grounded to the mounting plate 108 by line 150.

The pump 132 is electrically operatively connected to circuit board 126 by lines 152. The circuit board 126 is powered by low voltage carrying lines 153 and 154 which emanate from the transformer 82 through open surface 100. Line 154 directly connects to the circuit board 126 and line 153 indirectly connects to the circuit board via a fuse device 155 which is disposed through open surfaces 106 and 112. The transformer 82 is grounded to the mounting plate 108 by line 156.

The air pump assembly 16 provided is pressure sensitive and designed to accommodate a wide range of air pressure settings from about 3.5 inches to 16.5 inches water by adjusting the potentiometer member 81. Once a predetermined target pressure is selected and the air pump assembly 16 is normalized to such setting, if pressure begins to exceed about 2 inches above the predetermined target pressure, the solenoid valve 146 opens to vent the pressure until pressure drops below about 2 inches of the target pressure at which point the solenoid valve 146 closes to maintain pressure the target predetermined pressure.

Once assembled, the operation of the mattress 10 is as follows. The flap 92 is opened and the air pump assembly 16 is activated by actuating the soft/firm knob 88 to approximately a halfway point to achieve substantial inflation of the cells 14. At this point, a fitted linen sheet is desirably placed over the mattress 10.

Figure 7:
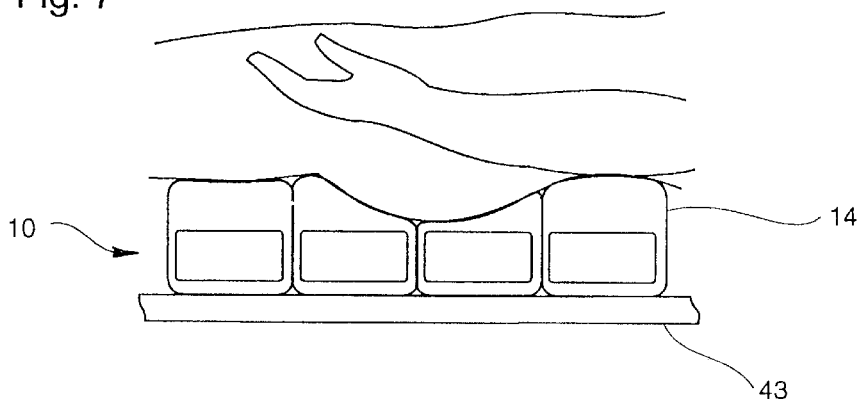
FIG. 7 is a partial side view of the mattress 10 of FIG. 1, with a patient positioned thereon.
Figure 8:
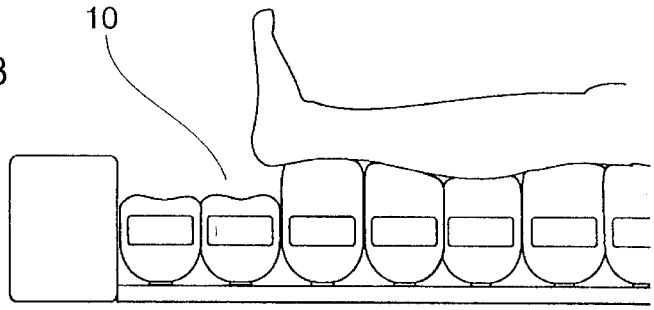
FIG. 8 is another partial side view of the mattress 10 of FIG. 1, with a patient positioned thereon.

The patient is transferred onto the mattress 10 and positioned in a supine position with feet disposed over the foot end cells 66 and chest over the torso region 72. Upon the patient's body being cradled by the cells 14 as represented in FIGS. 7 and 8, the soft/firm knob 88 is adjusted to stabilize the mattress 10 and appropriate foot end cell inflate/deflate knobs 84 adjusted to accommodate the heels of the patient as seen in FIG. 8. The flap 92 is then closed and the sheet completely tucked over the mattress 10 in a conventional manner.

Accordingly, by so providing the mattress 10 of the present invention, the patient has a highly customized mattress to suit his/her particular need. This is represented in FIGS. 7 and 8, wherein the individual cells 14 are deflated or inflated to accommodate the particular size and shape of extremity to be supported. Also, the mattress 10 may be fully inflated for purposes which require easier access to body surfaces, as for example, during bathing of or performing medical treatment on the patient. The present invention provides improved pressure relief for the patient. The invention also provides additional safety advantages with the capability of rapid deflation in the event emergency procedures are necessary, i.e., CPR is needed.

The above described embodiment is set forth strictly by way of example and is not for the purpose of limiting the present invention. It will be apparent to those skilled in the art that various modifications, substitutions and variations can be made to the embodiment while still capturing the essence of the invention. Accordingly, the claims appended hereto should be read in their full scope including any such modifications and variations.

What is claimed is:

1. A pressure reducing patient support system, which includes: a mattress comprising:

a plurality of inflatable cells, wherein a first of said cells is disposed at a foot end of said mattress;

a low-voltage air pump assembly operably connected to said inflatable cells for supplying air thereto, wherein said low voltage air pump assembly is a low-voltage (AC) air pump assembly powered by an external electrical current source;

wiring system which is not integrally associated with said mattress; and a plurality of controls integrally associated with said mattress and operably connected with said air pump assembly, wherein a first of said controls includes an actuator for controlling softness and firmness of said mattress by way of inflation and deflation of said cells and a second of said controls includes an actuator for individually controlling inflation and deflation of said first cell.

2. The patient support system of claim 1, wherein said air pump assembly is integrally formed in said mattress.

3. The patient support system of claim 1, wherein a second of said inflatable cells is disposed in a predetermined CPR mid-region of said mattress.

4. The patient support system of claim 3, which further includes means associated with said second cell for rapidly deflating said second cell.

5. The patient support system of claim 1, wherein a second of said inflatable cells is disposed at said foot end adjacent said first cell.

6. The patient support system of claim 5, wherein a third control includes an actuator for individually controlling inflation and deflation of said second cell.

7. The patient support system of claim 3, wherein a third of said inflatable cells is disposed in said CPR mid-region adjacent said second cell.

8. The patient support system of claim 7, which further includes means associated with said second cell and said third cell for rapidly deflating said second cell and said third cell.

9. A pressure reducing mattress having a semi-flexible base, which includes:

a plurality of inflatable cells operably disposed within said mattress base, wherein a first of said cells is disposed at a foot end of the mattress;

a low-voltage air pump assembly operably connected to said inflatable cells for supplying air to each said inflatable cell, wherein said air pump assembly is powered by alternating current (AC); and said alternating current is supplied to said air pump assembly at a voltage lower than line voltage through a transformer and wiring system which is not integrally associated with said mattress; and a plurality of controls integrally associated with said mattress and operably connected with said air pump assembly, wherein a first of said controls includes an actuator for controlling softness and firmness of said mattress by way of inflation and deflation of said cells and a second of said controls includes an actuator for individually controlling inflation and deflation of said first cell.

10. The patient support system of claim 9, wherein a second of said inflatable cells is disposed in a CPR mid-region of said mattress.

11. The patient support system of claim 10, which further includes means associated with said second cell for rapidly deflating said second cell.

12. The patient support system of claim 9, wherein a second of said inflatable cells is disposed in said foot end adjacent said first cell and wherein a third control includes an actuator for individually controlling inflation and deflation of said second cell.

13. The patient support system of claim 10, wherein a third of said inflatable cells is disposed in said mid-region adjacent said second cell and which further includes means associated with said second cell and said third cell for rapidly deflating said second cell and said third cell.

14. A patient support system, comprising:

a mattress comprising an inflatable cell;

a low-voltage air pump assembly integrally formed within said mattress for supplying and controlling air flow to said inflatable cell; and a detachable low voltage power supply for supplying power to said air pump assembly.

15. The mattress of claim 14, which includes a plurality of inflatable cells operably disposed within said mattress and connected to said air pump assembly, wherein a first of said cells is disposed at a foot end of the mattress and includes a plurality of controls integrally associated with said mattress and operably conected with said air pump assembly, wherein a first of said controls includes an actuator for controling softness and firmness of said mattress by way of inflation and deflation of said cells and a second of said controls includes an actuator for individually controlling inflation and deflation of said first cell.

16. The mattress of claim 15, wherein a second of said inflatable cells is disposed in said foot end and wherein a third control includes an actuator for individually controlling inflation and deflation of said second cell.

17. The mattress of claim 16, wherein a second of said inflatable cells is disposed in a CPR mid-region of said mattress and which further includes means associated with said second cell for rapidly deflating said second cell.

18. The mattress of claim 17, wherein a third of said inflatable cells is disposed in said CPR mid-region adjacent said second cell and wherein said deflating means is operably associated with said third cell for rapidly deflating said third cell.

* * * * *